US005372261A

United States Patent [19]

Galton et al.

[11] Patent Number: 5,372,261

[45] Date of Patent: * Dec. 13, 1994

[54] SYSTEM AND METHOD FOR SCREENING OR DIVERTING PARTICULATE MATERIAL

[75] Inventors: Zanley F. Galton, Portland; Lynn A. Russell, Scappose, both of Oreg.

[73] Assignee: Western Wire Works, Inc., Portland, Oreg.

[ * ] Notice: The portion of the term of this patent subsequent to May 25, 2010 has been disclaimed.

[21] Appl. No.: 67,479

[22] Filed: May 25, 1993

Related U.S. Application Data

[62] Division of Ser. No. 782,431, Oct. 25, 1991, Pat. No. 5,213,217.

[51] Int. Cl.[5] ..... B07B 1/49

[52] U.S. Cl. ..... 209/399; 209/408

[58] Field of Search ..... 209/399, 403, 405, 407, 209/408

[56] References Cited

U.S. PATENT DOCUMENTS

| | | | |
|---|---|---|---|
| 3,980,555 | 9/1976 | Freissle | 209/408 |
| 4,120,784 | 10/1978 | Hassall | 209/399 |
| 4,141,821 | 2/1979 | Wolff | 209/405 |
| 4,219,412 | 8/1980 | Hassall | 209/399 |
| 4,409,099 | 10/1983 | Wolff | 209/399 |
| 4,661,245 | 4/1987 | Rutherford et al. | 209/399 |
| 4,670,136 | 6/1987 | Schmidt et al. | 209/403 |
| 4,871,288 | 10/1989 | Schmidt et al. | 209/399 X |
| 4,960,510 | 10/1990 | Wolff | 209/399 X |
| 5,049,262 | 9/1991 | Galton et al. | 209/399 |
| 5,112,475 | 5/1992 | Henry, Jr. | 209/399 |

FOREIGN PATENT DOCUMENTS

| | | | |
|---|---|---|---|
| 167999 | 7/1985 | European Pat. Off. . | |
| 0167999 | 1/1986 | European Pat. Off. | 209/399 |
| 2849838 | 9/1979 | Germany | 209/399 |
| 3606854 | 9/1987 | Germany . | |
| 3606854 | 9/1987 | Germany . | |
| 2092917 | 8/1982 | United Kingdom | 209/399 |
| 1505601 | 9/1989 | U.S.S.R. | 209/399 |

*Primary Examiner*—James R. Bidwell

*Attorney, Agent, or Firm*—Marger, Johnson, McCollom & Stolowitz

[57] ABSTRACT

A system for screening or diverting particulate material includes replaceable screening or diverting modules mounted to a rigid frame by lock pin assemblies is provided. The lock pins are fixed into mounting holes in the frame and interlockingly and removably engage recess apertures in the sidewalls of the screening or diverting modules so that the lock pins remain fixed to the frame while allowing the modules to be removed and replaced as required due to wear or to change sieve size. The lock pin assembly comprising an elongate connector strip having first and second major opposite surfaces, a plurality of lock pins joined to the first major surface, and connectors joined to the second major surface for connecting the lock pin assembly to the frame. The lock pins includes devices for interlockingly and removably engaging the attachment apertures to maintain the positioning of each screening or diverting module on the frame when the lock pin assembly is attached to the frame. The lock pin assembly remains connected within at least one mounting aperture of the frame while allowing removal of a screening or diverting module from the frame and positioning of a replacement screening or diverting module on the frame.

23 Claims, 6 Drawing Sheets

SYSTEM AND METHOD FOR SCREENING OR DIVERTING PARTICULATE MATERIAL

RELATED APPLICATION

This is divisional application of U.S. Ser. No. 07/782,431, filed Oct. 25, 1991, Issued May 25, 1993 as U.S. Pat. No. 5,213,217.

BACKGROUND OF THE INVENTION

The invention relates to improved modules and methods and apparatus for removably retaining the modules on a rigid underlying support surface, to improved screening or diverting decks for screening or diverting particulate material, and more particularly to support frames which can be removed and replaced easily as circumstances require. Another aspect of the invention is directed to a means for connecting a screening or diverting module to an underlying support frame.

Various screening or diverting decks and screening or diverting elements are known which are intended for the same general purposes. An example of a crowned screening element is shown in U.S. Pat. No. 4,120,784. The screening element is crowned in order to pretension the element for greater strength. However, crowned elements are difficult to remove and install and wear unevenly.

Various ways are known for connecting a screening element to an underlying frame to form a screening deck. Some methods require spacers or adapter bars between the screening element and the frame. An example of such an arrangement is shown in U.S. Pat. No. 4,409,099. That patent shows screening elements supported only at their corners on spacer elements so that the screening element is spaced above the frame, ostensibly to increase the effective screening area. The intermediate spacer elements add considerably to the cost and complexity, and increase the height of the overall screening apparatus. In addition, specially formed frame members are required to reduce abrasion of frame members by the sifted particulate material. That requirement represents an expensive departure from standard practices in the industry.

Another screening apparatus that employs specialized components intermediate the screening elements and the support frame is shown in U.S. Pat. No. 4,219,412. There, a molded plastic frame is adapted to receive individual screening elements. The plastic frame, in turn, is connected to the frame. This combination leads to several disadvantages similar to the device of the U.S. '099 patent mentioned above. The '412 patent does not disclose whether or how individual screening modules might be removed and replaced.

Similarly, U.S. Pat. No. 4,661,245 shows a screening system that incorporates clamping bars which receive the individual screening elements. The clamping bars, in turn, are bolted onto the frame. The resulting structure is unduly complex, expensive, increases the height of the deck and suffers other shortcomings described below.

Several methods also are known for connecting flat screening elements directly to a supporting frame. One method is the use of a depending hook or skirt member integrally formed in the outlet side of the screening element. An example is shown in U.S. Pat. No. 3,980,555. According to that invention, depending hooks of abutting screening elements are inserted into a frame member through a common mounting hole. The hooks extend out of the mounting hole on the underside of the frame and engage the frame member to hold the screening elements in place. The resulting screening deck has a substantially contiguous inlet surface that provides no access to the mounting hooks for disconnecting an element which requires replacement. Accordingly, such arrangements require a user to climb under a screening deck and cut the depending hooks off of a module to be replaced. Or, more commonly, a user will pry the element off from the top (inlet side) and destroy it in the process. Either way, the module is rendered useless; a result that is acceptable for modules which are worn out, but wasteful if the module is being replaced merely to change sieve size.

Another attachment method is shown in U.S. Pat. No. 4,219,412, discussed above. There, individual screening elements are connected to an intermediate supporting frame by integrally formed depending hook-shaped members, similar to those disclosed in the U.S. '555 patent. Here, however, the depending hook members are inaccessible even from the outlet side of the screen, as they are enclosed within elongate U-shape channels. The '412 patent does not disclose any way of removing an individual screening element for replacement, short of disassembling the screening deck.

Another method of connecting screening elements to an underlying frame is to employ securing pins as suggested, for example, in U.S. Pat. No. 4,141,821. According to that invention, abutting screening elements each include hollow tubular protrusions extending through a common mounting aperture formed in the frame so as to define a hollow tube. A securing pin is inserted into the tube from the inlet side of the deck to spread the protrusions apart beneath the aperture and thereby engage the frame.

The securing pin taught in the U.S. Pat. No. 4,141,821 patent is difficult to pry out of the tube. The pin perhaps could be driven out from the outlet side of the screen. In any event, once removed, the pin is loose and therefore subject to loss. This is a decided risk in the context of screening machines, as it often is impractical or impossible to retrieve an errant securing pin. A similar securing pin is employed in the apparatus disclosed in U.S. Pat. No. 4,409,099.

An improved screening system developed by the common assignee of this patent application is provided in U.S. Pat. No. 5,049,262, and is incorporated herein by reference. The screening system includes a rigid frame and a plurality of screening modules. A lock pin is provided which detachably connects the screening modules to the rigid frame. The lock pin is designed so that it remains connected to the frame while allowing removal of the screening modules from the frame, and positioning of a replacement screening module on the frame.

Yet another apparatus for removably mounting screening elements is disclosed in U.S. Pat. No. 4,670,136. That patent discloses a two-piece elongate clamping element for clamping the edge of a plastic module or wire mesh screen. The apparatus includes a first, lower plastic profile fastened to the frame and arranged to engage under the edges of at least two mutually adjacent screen elements. A second, upper profile is detachably fastened over the first lower profile for retaining the screen elements clamped in place. Removal of a screening element requires removal of the upper plastic profile, thereby subjecting it to risk of loss like the securing pins of the U.S. '821 patent and the like. Additionally, the clamping structures of the U.S. '136 patent extend substantially beyond the edges of the frame, thereby reducing the effective screening area and subjecting the clamping structure itself to excessive wear from abrasion by particulate material being screened.

Another class of modular screen system are represented by European Patent No. 167,999 ("EP '999") and DE 3606-854 ("DE '854"). More specifically, EP '999 is directed to a modular screen system which includes an assembly for attaching sieve elements 2 to metal support girder 12. The attachment assembly comprises upper and lower profile sections 6 and 14, respectively, and a protective ledge 10. The upper profile section 6 engages the entire side portion of screen elements 2, while the lower profile section 14 is connected within a continuous slot in metal support girder 12. The upper profile can have a bolt-shape cross-sectional configuration. The protective ledge 10 covers the entire top surface of the support girder 12 to prevent wear from abrasive material passing through the sieve elements 2. Since the upper profile section 6 is in locking engagement with the entire extent of the side of the screen element 2, it is extremely difficult and time consuming for users to remove and replace individual damaged screen modules. Furthermore, this removal process often results in unwanted destruction adjacent undamaged screen modules. Also, longitudinal positioning is a problem since there is a minimum impediment to movement of the screen element 2 along the profile section 6.

Accordingly, the need remains for a system for effectively and efficiently screening particulate material which provides for fast, convenient and nondestructive replacement of screening modules.

SUMMARY OF THE INVENTION

The above-described needs have been met by the method and system of the present invention which comprises an effective and efficient means for screening or diverting particulate material which provides for fast, convenient and nondestructive replacement of screening or diverting modules means for removably retaining screening or diverting modules on a support frame without the use of securing pins, bolts or other parts which must be removed in order to remove a screening or diverting element and therefore are subject to being lost. The present invention maximizes the screening or diverting or impact area while providing for removing a screen or diverter from the inlet side of the screening or diverting or impact apparatus without requiring access to the underside of the support surface. The present invention also provides for removal of screening or diverting or impact elements without damage to the element or to the mounting surface or apparatus.

The screening or diverting system of the present invention comprises a frame for supporting a plurality of screening or diverting modules positioned thereon. The frame includes means defining at least one mounting aperture. Each screening or diverting module has a peripheral sidewall defining a plurality of attachment apertures. Each screening module also includes means defining an array of sieve apertures of a predetermined size for allowing particulate material up to the predetermined size to pass through the screening or diverting module.

A lock pin assembly is provided for readily, removably attaching the plurality of screening or diverting modules to the frame. The frame includes a plurality of elongate members spaced apart for supporting a plurality of screening or diverting modules positioned thereon. The lock pin assembly comprises an elongate connector strip having first and second major opposite surfaces. A plurality of lock pins joined to the first major surface. Means are joined to the second major surface for connecting the lock pin assembly to the frame. The lock pins include means for interlockingly and removably engaging attachment apertures in the frame to maintain the positioning of each screening or diverting module on the frame when the lock pin assembly is attached to the frame. The lock pin assembly remains connected within at least one mounting aperture of the frame while allowing removal of a screening or diverting module from the frame and positioning of a replacement screening or diverting module on the frame. The lock pins can include a head portion for interlockingly and removably engaging the screening or diverting module. The lock pin assembly is preferably formed of a resilient material.

Typically, the screening or diverting system includes means defining a recess aperture, and the lock pins in said lock pin assembly include a complimentary flange sized to fit within the recess aperture means. Preferably, the recess aperture means and the complimentary flange have a complimentary annular configuration. In a preferred configuration, the mounting aperture in the frame comprises a continuous, longitudinally-extending elongate slot, and the means for connecting the lock pin assembly to the frame comprises a continuous, longitudinally-extending elongate flange which is removably attachable within, and detachable from, the slot. The means for attaching the lock pin assembly to the frame can include means defining a longitudinally-extending groove having interior walls such that the lower portion of the means for attaching the lock pin assembly to the frame can be reduced by moving the interior walls together. In a preferred configuration, the attachment recess aperture means in the sidewall is substantially hemi-cylindrical and has its major axis substantially parallel to the flow path, and the head portion of the lock pin is substantially cylindrical, a section of the head portion being interlockingly engaged in the recess aperture means.

More specifically, the head portion of the lock pin includes an annular collar sized and positioned on the head portion for removably retaining each screening or diverting module abutting the frame.

In one form of the screening or diverting system of this invention, each adjacent pair of screening or diverting modules includes means in the sidewall defining a substantially hemi-cylindrical attachment aperture of a predetermined diameter having a longitudinal axis normal to the plane of the screening or diverting module for receiving the head portion of the lock pin. It also includes means defining a channel extending along the sidewall within the recess aperture parallel to the plane of the screening or diverting module. The pair of modules are positioned so that the attachment apertures in the opposed sidewalls of said modules are registered with each other to define, in combination, a substantially cylindrical recess aperture having a peripheral channel. Furthermore, the head portion of the lock pin is generally cylindrical, having a diameter substantially equal to the diameter of the cylindrical attachment aperture for interlocking engagement in the cylindrical recess aperture, whereby a bilaterally symmetric half of the head portion extends within the recess aperture in a first one of the pair of modules and the other half of the head portion extends within the recess aperture in the second module. The head portion of the lock pin further includes an annular collar extending around the head portion, the collar being sized for interlocking engagement in the peripheral channel for removably retaining the pair of modules abutting the frame. The screening or diverting module includes parallel peripheral sidewalls, defines a flow path, and is positioned on the frame with the sidewalls extending respectively over a corresponding pair of the elongate members. The screening or diverting module also includes means defining a hemi-cylindrical recess aperture of a predetermined diameter in the sidewall, the recess aperture having an axis generally parallel to the flow direction, and means defining a channel extending along the sidewall within the recess aperture and normal to the flow direction. In this case, the lock pin includes a generally cylindrical head portion having a diameter complimentary to the diameter of the recess aperture for interlockingly engaging the recess aperture to maintain the positioning of the module on the frame and also includes an annular collar extending around the head portion, sized and positioned for interlockingly engaging the channel to retain the module abutting the frame. Preferably, the attachment aperture includes means defining a recess aperture, and the lock pins include a complimentary flange sized to fit within said recess aperture means, more preferably a complimentary annular configuration.

In another form of this invention, the lock pin base portion includes a generally cylindrical region having a diameter greater than the diameter of the mounting aperture, means in the cylindrical region defining an annular recess aperture having an interior diameter substantially equal to the diameter of the mounting aperture so that, upon engagement of the base portion through the mounting aperture, the base portion lockingly engages the frame about the mounting aperture, and means in the cylindrical region defining a transverse slot having interior walls, longitudinally extending into the recess aperture from the bottom end, whereby the diameter of the cylindrical region below the recess aperture can be reduced by moving the interior walls together to facilitate insertion of the base portion through the mounting aperture. Preferably, the base portion is tapered inwardly below the recess aperture to facilitate inserting the lock pin through the mounting aperture. The screening or diverting system can also include means for removably engaging a second screening or diverting module abutting the screening or diverting module in side-by-side relationship on the frame for removably connecting the second screening or diverting module to the frame.

This invention also relates to various methods. In one such method for producing a screening or diverting system, the above-described rigid, planar frame for supporting a screening or diverting module thereon, at least one screening or diverting module, and at least one lock pin assembly are provided. Each lock pin assembly is then connected to the frame by inserting the attachment means of the lock pin assembly into each mounting aperture so that the second major surface of the elongate connector strip is disposed on the frame. The screening or diverting module is located on the frame by interlockingly and removably engaging each attachment aperture and a corresponding lock pin so that particulate material passes through the screening module, or is diverted by the diverting module, and the frame and the lock pin assembly maintain the positioning of the screening or diverting module on the frame.

The screening or diverting modules can be replaced by disengaging the attachment aperture of each screening or diverting module to be replaced from its corresponding lock pin, and removing the screening or diverting module to be replaced while the lock pin assembly remains connected to the frame. Next, a replacement module is positioned on the frame and locating on the frame by interlockingly and removably engaging each attachment aperture and a corresponding lock pin so that particulate material passes through the screening module, or is diverted by the diverting module, and the frame and the lock pin assembly maintains the positioning of the screening or diverting module on the frame.

The foregoing and other objects, features and advantages of the invention will become more readily apparent from the following detailed description of a preferred embodiment which proceeds with reference to the drawings.

DETAILED DESCRIPTION OF A PREFERRED EMBODIMENT

Figure 2:
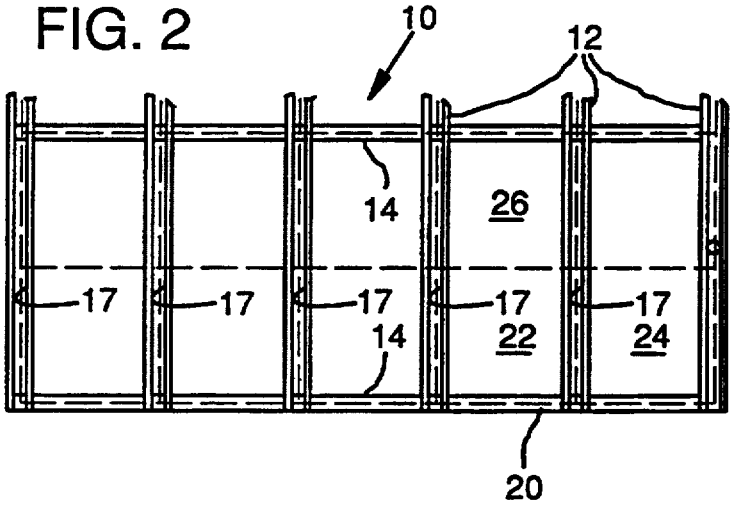
FIG. 2 is a fragmentary top plan view of a screening or diverting deck frame showing the locations of mounting slots for mounting screening or diverting modules to the frame and indicating in dashed lines the positioning of screening or diverting modules on the frame.

Referring to FIG. 2, a screening deck frame 10, shown in top view, comprises a series of rigid elongate members 12 spaced apart in parallel relationship. The elongate members 12 are interconnected at regular intervals by cross-members 14 to strengthen the frame and to support screening modules positioned on the frame as further described below. Frame members 12, 14 may be of any suitable cross-sectional shape, though an aspect of the present invention includes a specific improved frame member, described herein subsequently. The frame members are fixed to each for example, by welding to form a regular grid.

Figure 1:
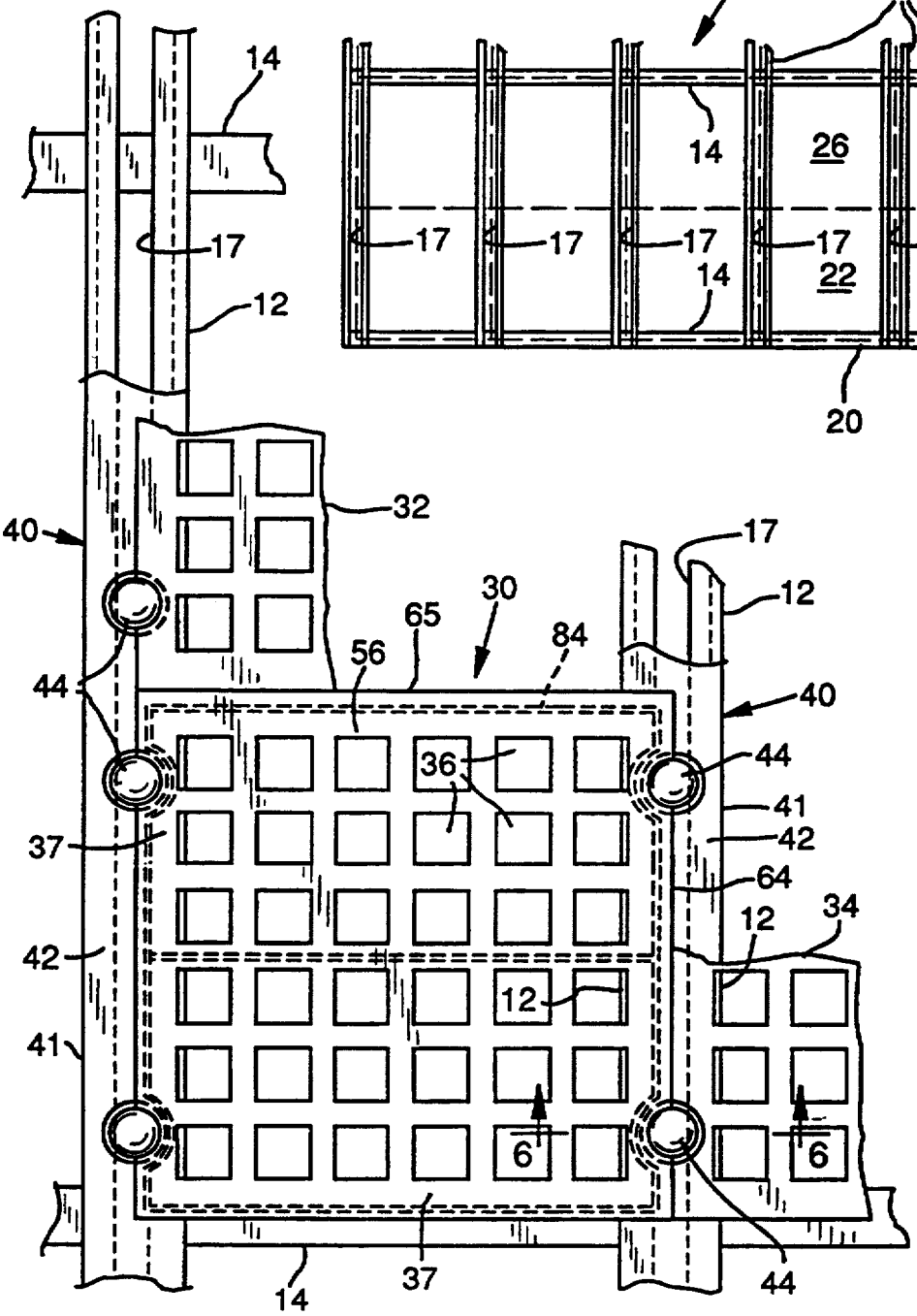
FIG. 1 is a fragmentary top plan view of a screening or diverting deck showing an improved screening or diverting module removably connected to a frame by the lock pin assembly of the present invention.

Frame 10 thus defines either a series of screening apertures delineated by dashed lines 20 in FIG. 2, for example, screening apertures 22, 24 and 26. Adjoining screening apertures, for example, apertures 22 and 26, may be covered by square screening modules, denoted 30 and 32, abutting each other end-to-end as shown in FIG. 1. Alternatively, a single rectangular module (not shown) may be positioned on the frame over adjoining apertures such as apertures 22 and 26. Elongate frame members 12 each includes a continuous mounting slot 17 or a series of mounting apertures 16 spaced apart along the elongate member (in phantom), either of which is oriented normal to the plane of the elongate member for positioning and removably connecting screening modules to the frame.

Referring now to FIG. 1, an enlarged fragmentary top view of an assembled screening deck is shown. The screening deck includes a conventional frame, such as shown in FIG. 2, and a series of screening modules 30, 32, 34 mounted onto the frame. The screening modules 30, 32, 34 are substantially identical. Each module includes peripheral sidewalls 64 and endwalls 65. Modules 30 and 34 are arranged with the sidewalls 64 abutting each other in side-to-side relationship such that the abutting sidewalls are substantially centered over elongate frame member 12. Each module straddles two adjacent elongate frame members 12. Module 32 is positioned abutting module 30 in end-to-end relationship. The modules thus abut one another on all sides so as to form a substantially contiguous screening sieve.

Screening module 30 includes a grid defining an array of sieve apertures 36, each of predetermined size, for allowing particulate material up to the predetermined size to pass through the screening module. A solid peripheral margin 37 surrounds the grid for supporting the module on the frame. Cross-members 14 are spaced apart such that two modules 30, 32 cover the pair of screening apertures, such as apertures 22 and 26, intermediate two adjacent cross-members 14. The screening modules 30, 32, 34 are removably connected to elongate members 12 by lock pin assembly 40 as hereinafter described.

Screening module 30 includes a top or inlet side 56 and an outlet side 60 (see FIGS. 3–7). Interior walls 38 of each sieve aperture 36 are slanted slightly outwardly toward the outlet side 60 of the module. The sieve apertures 36 thus have a slightly large dimension at the outlet side to prevent particulate material from becoming lodged in the module.

Figure 9:
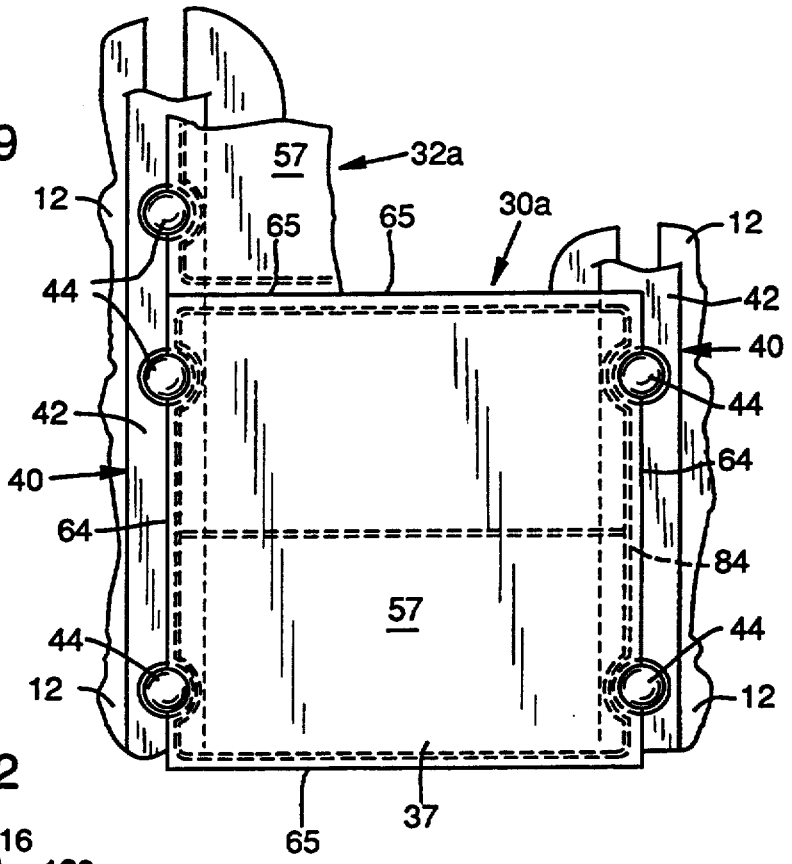
FIG. 9 is a fragmentary top view of FIG. 1, except for an improved solid impact module removably connected to an underlying support surface by a pair of lock pin assemblies.

Referring now to FIG. 9, an enlarged fragmentary top view of an assembled solid impact module system is shown. The system includes a section of an underlying support surface which can comprise various surfaces to which any of the modules can be mounted, such as frame 12 having series of apertures 16 or a continuous slot 17 as shown in FIG. 2. A series of impact modules 30*a* and 32*a* are mounted onto the underlying support surface 12. The impact modules 30*a* and 32*a* are substantially identical, although they can be of different configurations such as an impact module in combination with a screening module. Each of the screening or impact modules of this invention include peripheral sidewalls 64 and endwalls 65, a top impact surface 57 and a bottom surface 60. Module 32*a* is positioned abutting module 30*a* in end-to-end relationship. It also includes internal reinforcing frame 84 as hereinafter described in more detail. The screening and impact modules of the present invention are arranged as described with respect to system 10 above to abut one another on all sides so as to form a substantially contiguous screening sieve, or a solid impact surface as hereinafter described.

Modules 30*a* and 32*a* are solid impact members for diverting particulate material. The module 30*a* and 32*a* can be produced from a number of solid impact materials, but is preferably formed of metal or an impact-resistant polymeric material, particularly elastomeric materials. Examples of the polymeric materials which can be employed in scope of the present invention are polyurethane, EPDM, natural rubber, SBR, ABS, butyl rubber, polypropylene, and the like. A solid peripheral margin 37 is provided for supporting the module on the frame. The screening modules 30*a* and 32*a* are removably connected to support surface 12 by lock pin assembly 40.

Referring now to FIGS. 1 and 3–9, lock pin assembly 40 for readily, removably attaching the screening and impact modules 30 and 30*a* to the frame 12 is shown in greater detail. Lock pin assembly 40 (FIGS. 6–8) or 40′ (FIGS. 3–5) comprise an elongate connector strip 41 having first and second major opposite surfaces 42 and 43. It can also include protective side flanges (not shown) which can be attached to connector strip 41. Lock pin portions 44 are joined to first major surface 42, and an elongate attachment profile 47 (assembly 41) or a plurality of base portions 46 (assembly 41′) is joined to second major surface 43. Lock pin portions 44 are generally cylindrical and are formed of a resilient material, preferably a polymeric material. Accordingly, the lock pin portion 44′ includes a head portion 45, which acts as a diverter for material passing onto the screening or diverting modules 30, and a lower portion 62 having a diameter approximately equal to the diameter of lower portion 72 of recess aperture 66, and an upper portion 63 having a diameter approximately equal to the diameter of upper portion 73 of recess aperture 66. The head portion of the lock pin is rounded at the top end to form a generally hemispherical crown 94 to divert particulate material toward the screening or diverting area, i.e. the array of sieve apertures 36. Additionally, recess aperture 66 is enlarged at the outlet side 60 of the module to form inlet portion 69. The recess aperture includes a chamfered region 68 intermediate the enlarged inlet portion 69 and the lower cylindrical portion 72.

Figure 4:
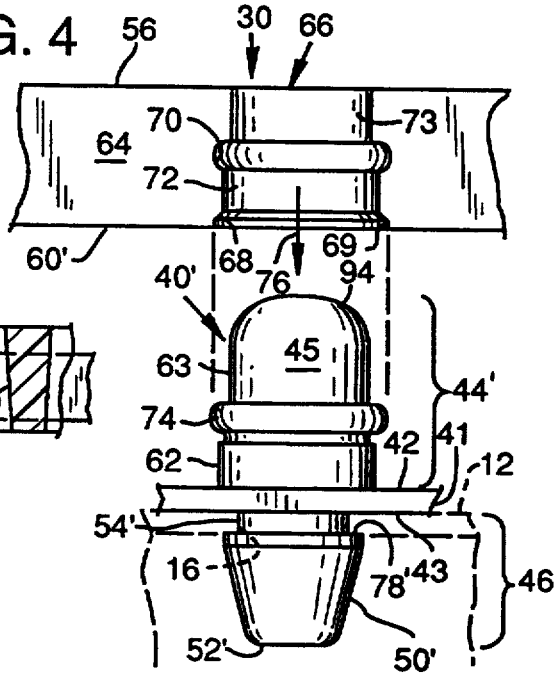
FIG. 4 is an exploded side plan view of a screening or diverting module and a lock pin assembly including individual lock pin sections and corresponding individual base sections, aligned for interlockingly and removably engaging each other and further showing a portion of an underlying frame member in phantom.
Figure 6:
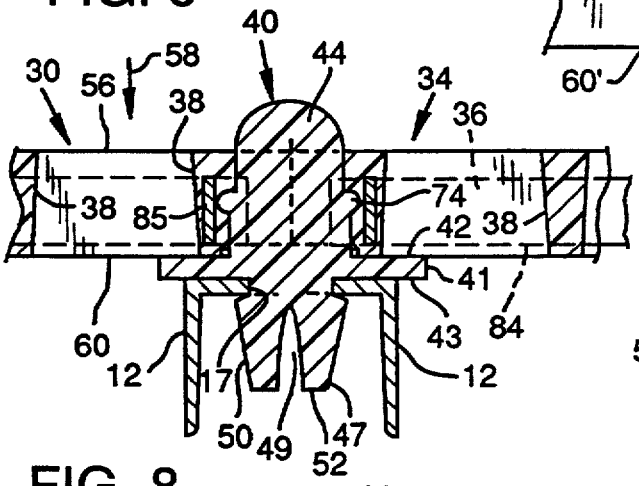
FIG. 6 is a cross-sectional view taken along line 6—6 of FIG. 1 showing in greater detail the interconnection of two abutting screening or diverting modules, a lock pin assembly including individual lock pin sections and a corresponding continuous, longitudinally-extending elongate flange, and the underlying frame member.
Figure 7:
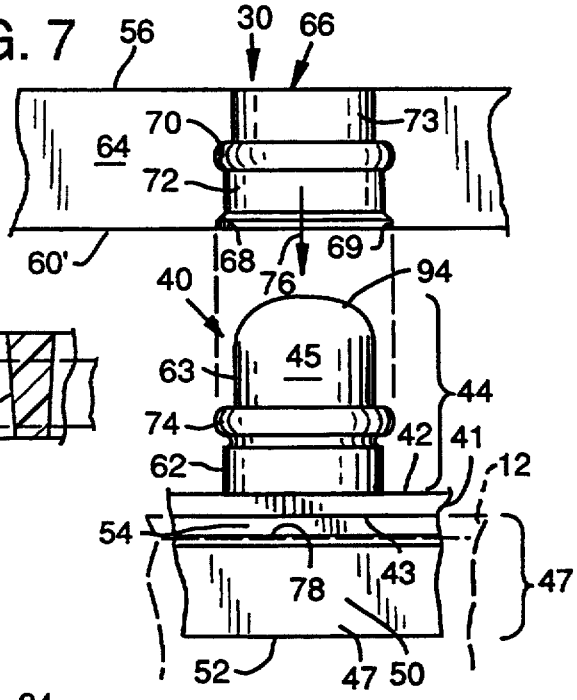
FIG. 7 is an exploded side plan view of a screening or diverting module and a lock pin assembly including individual lock pin sections and a corresponding continuous, longitudinally-extending elongate flange, such as shown in FIG. 1, aligned for interlockingly and removably engaging each other and further showing a portion of an underlying frame member in phantom.

Referring to FIGS. 4, 6 and 7, a channel 70 extends along sidewall 64 within recess aperture 66 and parallel to the plane of the module, which can be of solid or apertured construction. Channel 70 thus extends perpendicular to flow direction 58 intermediate the upper portion 73 and lower portion 72 of recess aperture 66. Lock pin assembly 40 includes a corresponding annular collar 74 on the head portion having a cross-sectional configuration complementary to the cross-sectional configuration of channel 70 for interlocking engagement in channel 70 for removably retaining the module in position abutting a support surface, such as frame member 12.

Modules 30, 34 include peripheral sidewalls 64. A generally hemi-cylindrical recess aperture 66 is formed in the sidewall 64, having an axis normal to the plane of the module for connecting the module to the frame. Recess aperture 66 is sized to receive a bilaterally symmetric one-half of the head portion 45 of lock pin assembly 40 as illustrated in FIG. 4 and 7. The bilaterally symmetric one-half of lock pin assembly 40 is defined by an imaginary plane passing through the longitudinal axis of the lock pin and parallel to the frame member 12. The imaginary plane divides the head portion into a pair of bilaterally symmetric halves. Recess aperture 66 is further illustrated in side view in FIGS. 4 and 7. Recess apertures 66 in abutting modules 30, 34 in combination form a substantially cylindrical aperture.

Modules 30 and 34 are connected to the frame by first installing lock pin assembly 40 on the frame; positioning the module with recess aperture 66 aligned over lock pin portions 44; and then pressing the module down onto the lock pins as indicated by arrow 76 in FIG. 4 and 7 until the outlet side 60 of the module contacts the major surface 42, thereby interlockingly engaging the lock pin portions 44 and the module. The recess aperture 66 may be of uniform diameter, in which case the head portion 45 of lock pin 40 correspondingly would be of uniform diameter. Alternatively, the recess aperture 66 may include an upper portion 73 having a first diameter and a lower portion 72 having a second diameter somewhat less than the diameter of upper portion 72, as shown in FIGS. 4 and 7.

An internal support member 84, shown in phantom in FIG. 1, is provided to stiffen module 30, particularly to prevent deformation of the module in the flow direction caused by the weight of particulate material on the inlet side of the module. Internal frame 84 is formed of material generally rectangular in cross-section, having its greater dimension parallel to peripheral sidewall 64 of the module. Internal frame 84 is formed to include an indentation 85 extending alongside recess aperture 66 to strengthen the module in the area of the recess aperture for more secure engagement of the module with the lock pin. The arrangement of support frame 84 "on edge", as illustrated, provides maximum rigidity in the direction of flow of particulate material, indicated by arrow 58 (FIG. 3 & 6), in order to keep the module flat, while permitting elastic deformation of the module in a direction generally normal to the flow direction, especially around recess aperture 66, to allow engagement and disengagement of the module and the lock pin portions 44.

Figure 3:
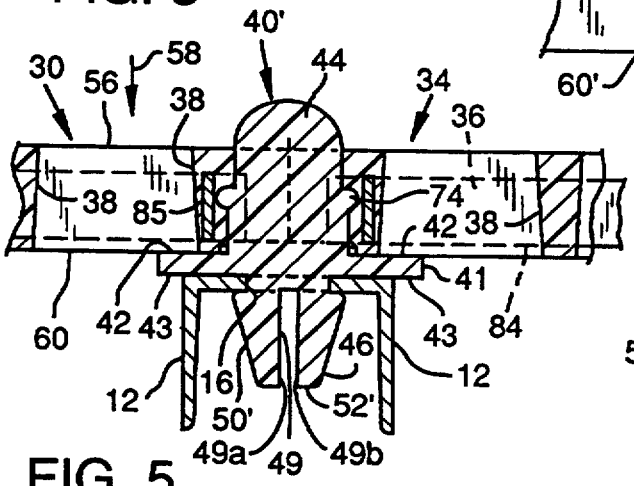
FIG. 3 is a cross-sectional view showing in greater detail the interconnection of two abutting screening or diverting modules, a lock pin assembly including individual lock pin sections and corresponding individual base sections, and the underlying frame member.
Figure 5:
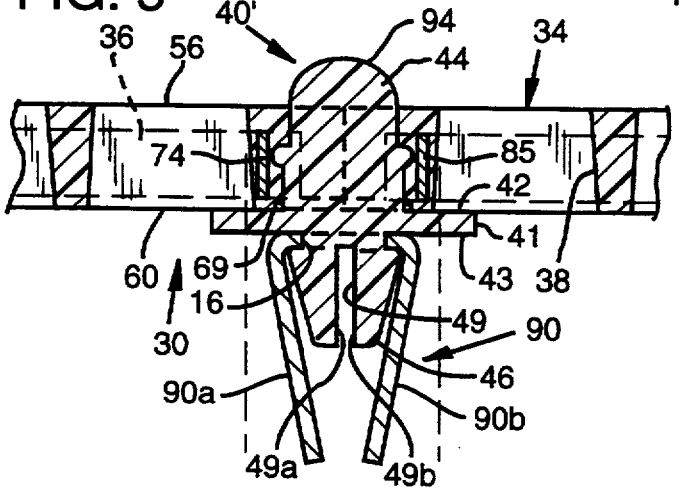
FIG. 5 is a fragmentary cross-sectional view illustrating the inter-relationship of an abutting pair of screening or diverting modules removably connected by a lock pin assembly as in FIG. 3, including individual lock pin sections and corresponding individual base sections, except that it is connected to a frame member having a tapered U-shape.
Figure 8:
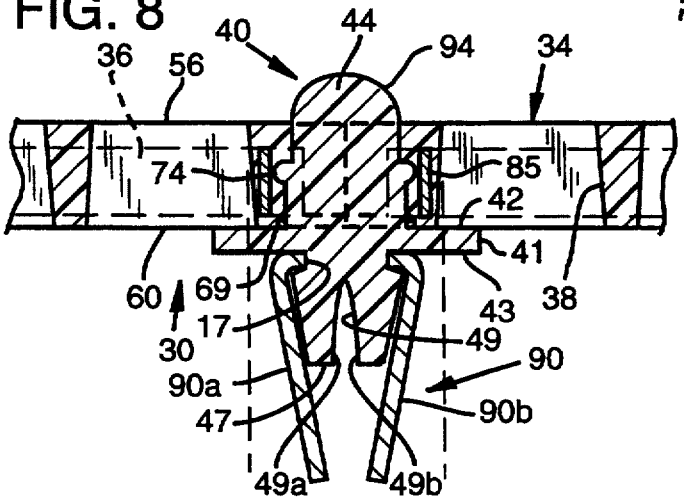
FIG. 8 is a fragmentary cross-sectional view illustrating the inter-relationship of an abutting pair of screening or diverting modules removably connected by a lock pin assembly as in FIG. 6, including individual lock pin sections and a corresponding continuous, longitudinally-extending elongate flange, except that it is connected to a frame member having a tapered U-shape.

FIGS. 5 and 8 are similar to FIGS. 3 and 6 except that FIGS. 5 and 8 are disposed within an improved tapered frame member 90. Referring back to FIGS. 3 and 6 for comparison, the elongate members 12 in a conventional frame extend beyond the solid margin 37 of screening aperture 30 and into the material flow path. As a result, particulate material that passes through sieve apertures 36 alongside frame members 12 abrades and thereby wears the frame members. This requires eventual replacement of the frame members 12.

Referring now to FIGS. 5 and 8, an improved frame member 90 is shown, having a tapered U-shape cross-section. Frame member 90 supports the modules 30, 34 as do frame members 12, but the improved frame member 90 does not extend into the path of particulate material passing through the modules. Frame member 90 includes depending sidewalls 90*a*, 90*b*. Sidewalls 90*a*, 90*b* are tapered inwardly to allow screened material to pass by the frame without contacting the frame member 90, so it is not subject to destructive wear. The sidewalls depend at an angle that is generally greater than the angle of sieve aperture sidewall 38. Frame members 90 may be interconnected by conventional cross members 14 having, for example, rectangular cross-sectional shape, as the cross members are not exposed to the particulate material.

As provided above, elongate frame members 12 each include either a continuous mounting slot 17 or a series of mounting apertures 16 spaced apart along the elongate member (in phantom), either of which is oriented normal to the plane of the elongate member for positioning and removably connecting screening modules to the frame. As shown in FIGS. 3–8, the base portion of the screening system 10 can comprises either a continuous, longitudinally-extending flange 47 which connects within continuous mounting slot 17 (see FIGS. 3–5), or a series of base Sections 46 which connect within complementary mounting apertures 16.

Referring to FIGS. 6–8, the continuous flange section 47 includes a continuous recess 54 having a width substantially equal to the width of the continuous slot 17 in the frame 12. Prior to installing the screening modules, the flange section 47 of lock pin assembly 40 is inserted into the continuous slot 17 from the top side of the frame so that surface 43 of elongate connector strip 41 is located on frame 12. Flange section 47 is tapered inwardly along edges 50 and includes a bottom edge 52. An elongate transverse slot 49 extends longitudinally and includes interior walls 49*a* and 49*b*. The width of flange section 47 below the width of the continuous recess 54 can be reduced by moving the interior walls 48*a*, 48*b* together, to facilitate insertion of the flange section 47 into the continuous slot 17. Once fully engaged in slot 17, as shown in FIGS. 6 and 8, the flange section 47 lockingly engages the frame member 12 about the slot 17. Elongate shoulder 78 contacts the underside of frame member 12, thereby fixing the lock pin assembly 40 to the frame. The lock pin assembly is very difficult to remove from the frame. One way, however, is by cutting off the base portion. Generally, it is unnecessary to remove the lock pin assembly 40 as the present invention allows removal and replacement of screening modules as necessary without such removal.

Referring to FIGS. 3–5, the base section 46 of each of the lock pin assembly 40' depicted therein includes an annular recess aperture 54' having a diameter substantially equal to the diameter of mounting aperture 16 in the frame. Prior to installing the screening modules, the lock pin assembly 40' is inserted into each mounting aperture 16 from the top side of the frame. Base section 46 is tapered inwardly along edges 50' and rounded adjacent the bottom end to form a blunt nose 52' to facilitate insertion of the lock pin into the mounting aperture. A transverse slot 49 extends longitudinally into the base portion 46 from the nose 52'. The transverse slot has interior walls **49*a* and 49*b*. The diameter of base portion 46 below the annular recess aperture 54' thus can be reduced by moving the interior walls 49*a*, 49*b* together, to facilitate insertion of the base portion through the mounting aperture 16. Once fully engaged in the mounting aperture 16, as shown in FIGS. 3 and 5, the base portion lockingly engages the frame member 12 about the mounting aperture 16. Annular shoulder 78' contacts the underside of frame member 12, thereby fixing the lock pin assembly 40' to the frame. The lock pin assembly is very difficult to remove from the frame except by cutting off the base portion 46. However, as stated above, it is typically unnecessary to remove the lock pin as the present invention allows removal and replacement of screening modules as necessary, without removing the lock pin assembly 41'**

Figure 12:
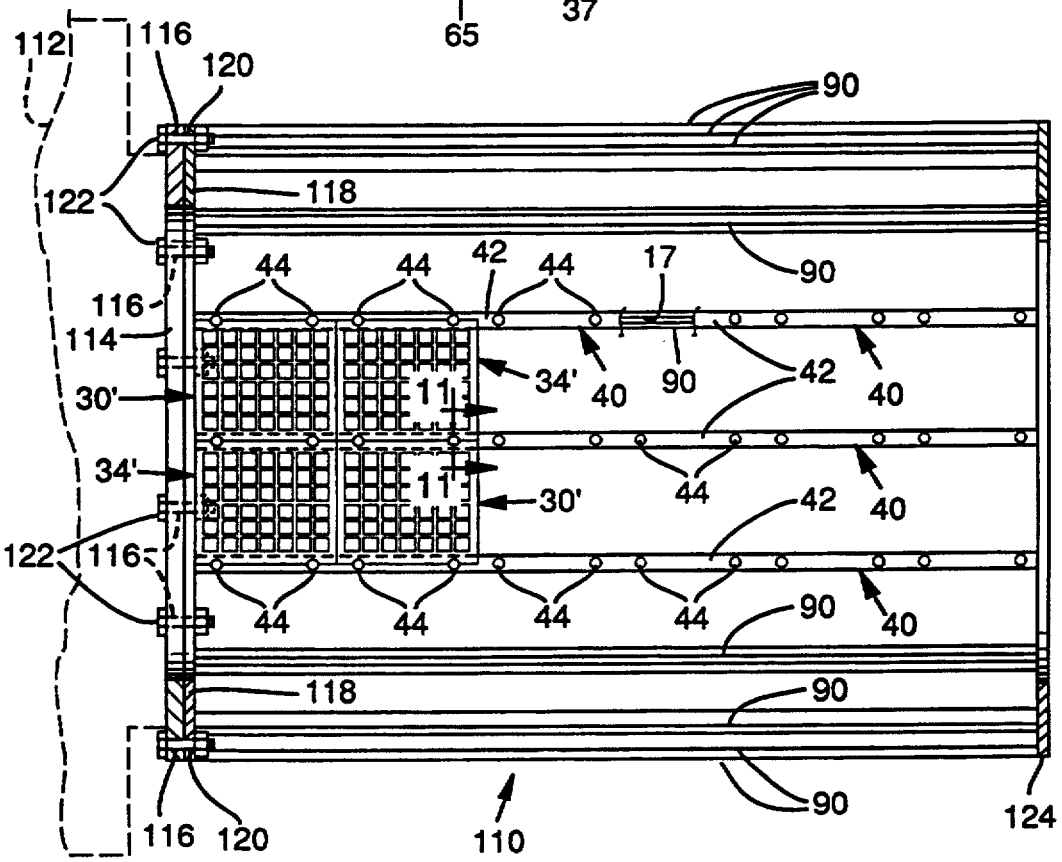
FIG. 12 is a side elevation view of the trommel of FIG. 10.
Figure 13:
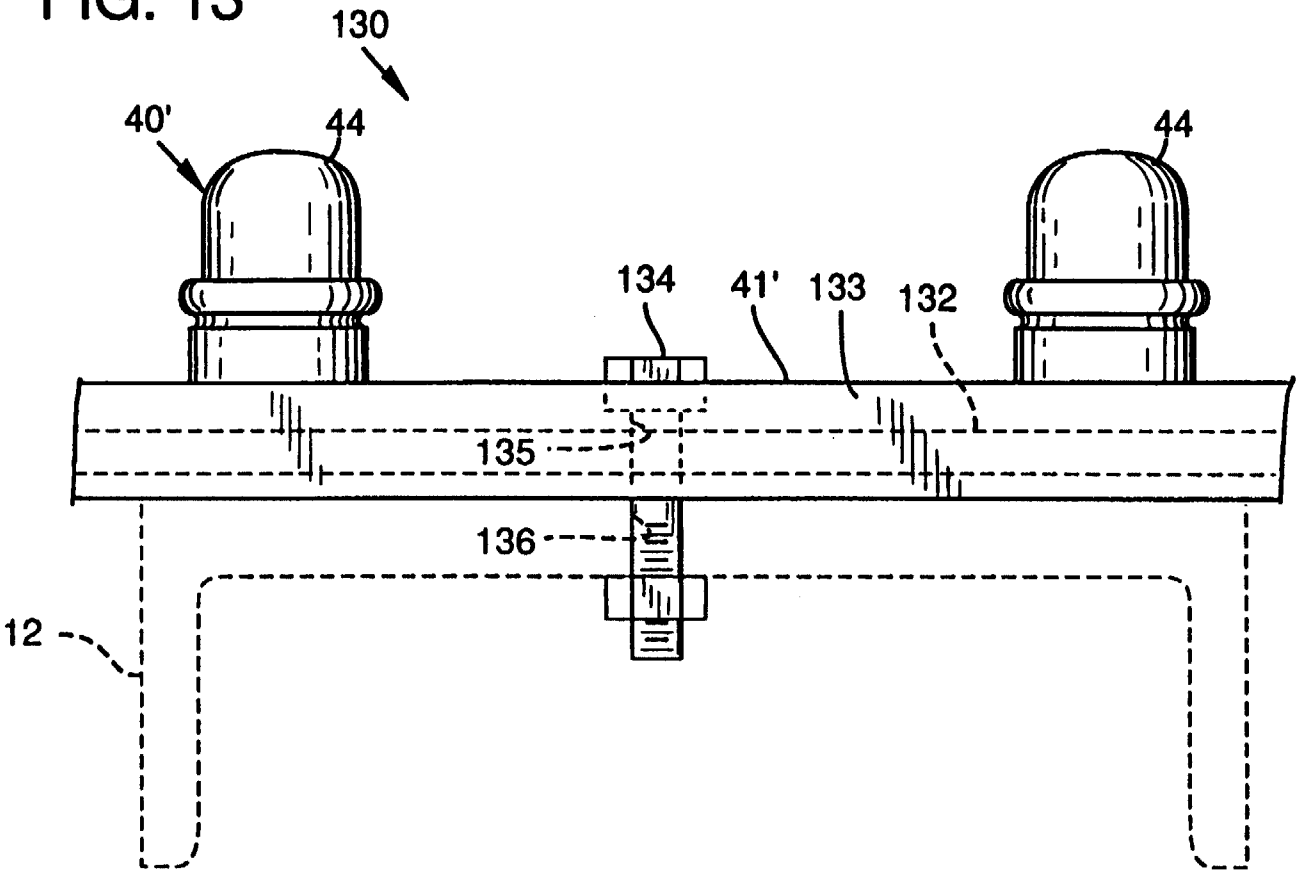
FIG. 13 is a fragmentary cross-sectional view of an alternative form of lock pin assembly 40 having lock pin portions 44 similar to those depicted in FIGS. 1–12, but having an elongate strip portion 41 which connected to frame 12 by separate attachment means.

FIG. 13 is a fragmentary cross-sectional view of an alternative form of lock pin assembly 40' having lock pin portions 44 similar to those depicted in FIGS. 1–12, but having a different elongate strip portion 41' which connects to frame 12 by separate attachment means 134, typically a nut and bolt assembly. More specifically, elongate strip portion 41' includes an inner reinforcement portion 132, preferably comprising an elongate rigid inner reinforcement portion fabricated of metal or a rigid polymeric material. Inner reinforcement portion 132 is encapsulated within an outer protective portion 133 which typically comprises a polymeric material, preferably an impact resistant polymeric material. Lock pin assembly 40' included a series of spaced apart holes 135 which correspondently align with a series of apertures 136 in frame 12. Thus, attachment means 134 pass through aligned holes 135 and apertures 136 and connect lock pin assembly 40' to frame 12.

Figure 10:
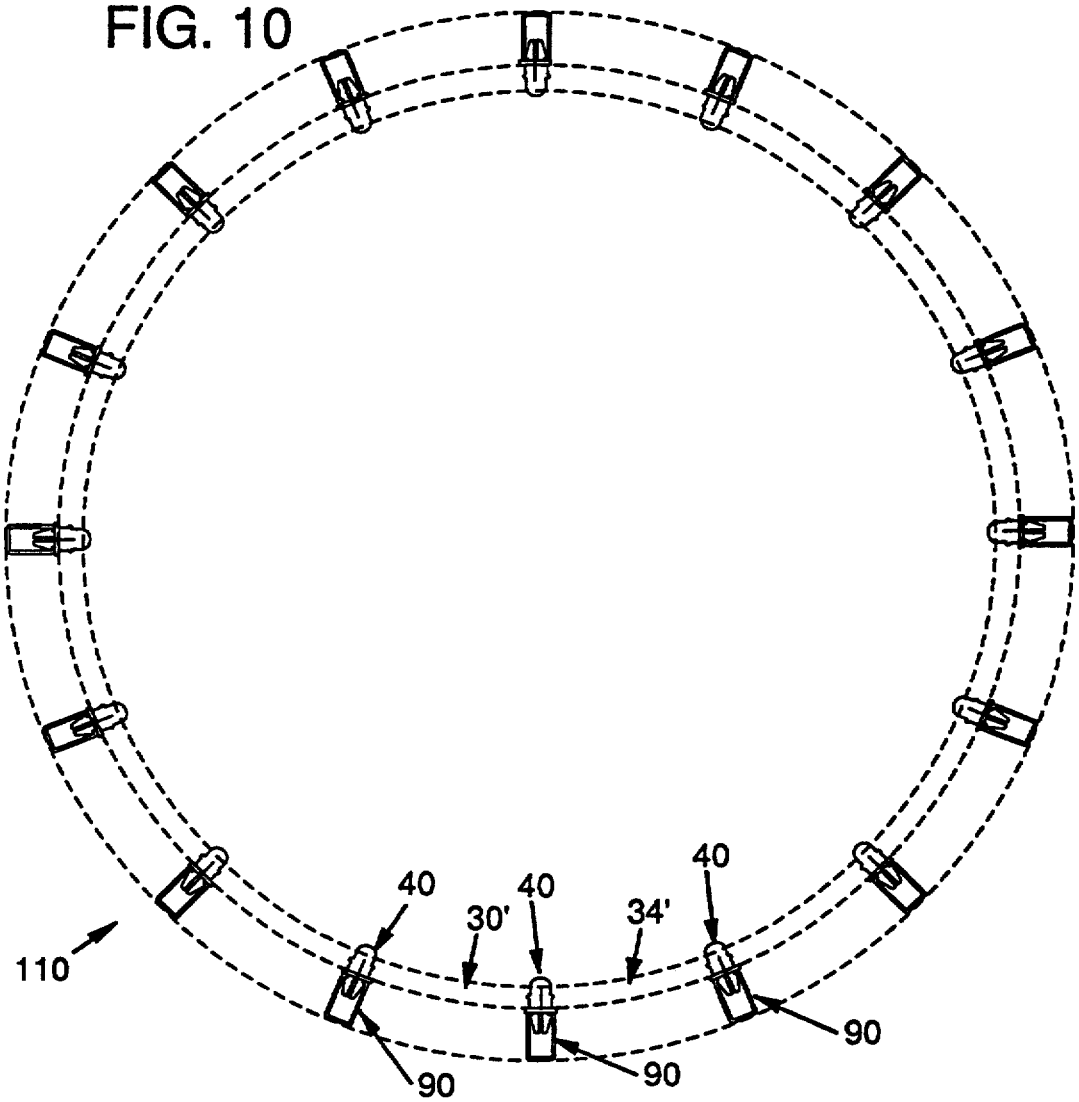
FIG. 10 is an end view of a trommel including the screening or diverting module system of the present invention.
Figure 11:
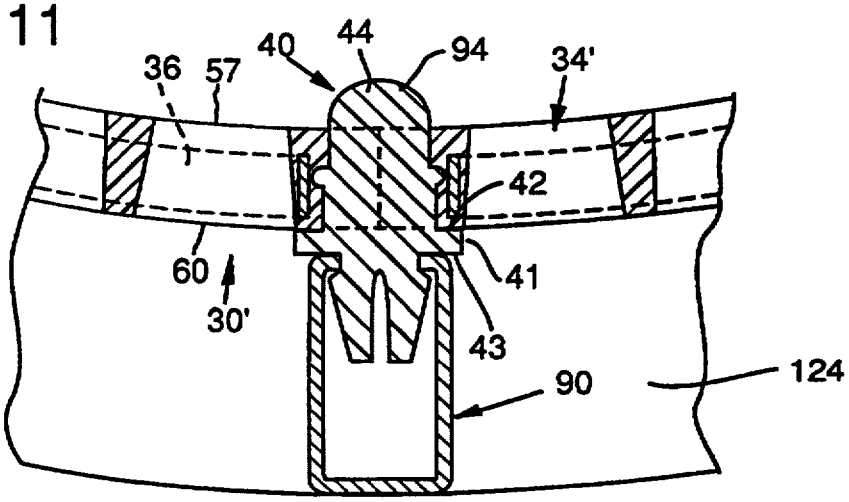
FIG. 11 is a fragmentary end view of the trommel of FIG. 10 taken along line 11—11 of FIG. 12.

Another use of the modular system of this invention is shown in FIGS. 10–12. More specifically, a trommel 110, which in this case is cantilevered at free end 124, is provided for screening or transporting particulate material according to a predetermined size by rotation about a horizontally-extended central axis. In the typical case, the material is fed into a means 112 for supporting and rotating the trommel (in phantom in FIG. 12), such as a Sag mill or ball mill. The material passes in a horizontal path through the central passageway of the trommel 110. The undersized particles pass through the sieve apertures of the modules 30' and 34', and the oversized material passes through trommel 110 and out of the free end. The support and rotation means 112 includes at its outlet end a support flange 114 having bolt holes 116 contained therein. The trommel 110 has a support flange 118 includes matching bolt holes 120 to the bolt holes 116. Within these bolts holes 116 and 120, respectively, are bolts 122 which connect the trommel 110 to the support and rotation means 112. Curved screening modules 30' and 34' are attached to a underlying support surface, in this case a plurality of horizontally-extending frame members 90, by lock pin assemblies 40 to form the cylindrical overall shape of the trommel 110. FIGS. 10 and 11 shows the specific manner of attachment of the modules 30' and 34' to the frame 90 using lock pin assemblies 40. Frame members 90 are welded at its respective needs to trommel bolt flange 120 and trommel end flange 124.

Having illustrated and described the principles of my invention in a preferred embodiment thereof, it should be readily apparent to those skilled in the art that the invention can be modified in arrangement and detail without departing from such principals.

I claim:

1. A module system for screening or diverting particulate material comprising:

a frame for supporting a plurality of screening or diverting modules positioned thereon including means defining at least one mounting aperture;

a plurality of screening or diverting modules, each screening or diverting module having a peripheral sidewall defining a plurality of attachment apertures, each said screening module including means defining an array of sieve apertures off a predetermined size for allowing particulate material up to the predetermined size to pass therethrough, and each diverting module including an impact surface for diverting said particulate material, each said attachment aperture includes means defining a recess aperture, and said lock pins including a complimentary flange sized to fit within said recess aperture means;

a lock pin assembly for readily, removably attaching said plurality of screening or diverting modules to said frame, said lock pin assembly comprising an elongate connector strip having first and second major opposite surfaces, a plurality of lock pins joined to said first major surface, and means joined to the second major surface for connecting the lock pin assembly to said frame, said lock pins including means for interlockingly and removably engaging said attachment apertures to maintain the positioning of each screening or diverting module on the frame when the lock pin assembly is attached to the frame, and said lock pins further including a head portion for interlockingly and removably engaging the screening or diverting module, said lock pin assembly remaining connected within at least one mounting aperture of the frame while allowing removal of a screening or diverting module from the frame and positioning of a replacement screening or diverting module on the frame, said means for connecting the lock pin assembly to the frame comprising a plurality of base sections which are removably attachable within, and detachable from, said each mounting aperture.

2. A screening or diverting system according to claim 1, wherein said recess aperture means and said complimentary flange have a complimentary annular configuration.

3. A screening or diverting system according to claim 1, wherein the base sections have an annular configuration.

4. A screening or diverting system according to claim 1, wherein each base section is tapered inwardly along its edges and rounded adjacent its bottom end to form a blunt nose to facilitate insertion of the lock pin into the mounting aperture.

5. A screening or diverting system according to claim 1, wherein the means for attaching the lock pin assembly to the frame includes means defining a longitudinally-extending groove having interior walls such that the lower portion of the means for attaching the lock pin assembly to the frame can be reduced by moving the interior walls together.

6. A screening or diverting system according to claim 5, wherein:

the attachment recess aperture means in the sidewall being substantially hemi-cylindrical and having its major axis substantially parallel to a flow path of the particulate material; and the head portion of the lock pin being substantially cylindrical, a section of the head portion being interlockingly engaged in the recess aperture means.

7. A screening or diverting system according to claim 6, wherein the head portion of the lock pin includes an annular collar sized and positioned on the head portion for removably retaining each screening or diverting module abutting the frame.

8. A screening or diverting system according to claim 1, wherein said frame includes a plurality of spaced apart mounting apertures, said means for connecting the lock pin assembly to the frame includes a plurality of spaced apart openings which align with said mounting apertures, and attachment means which pass through said aligned mounting apertures and openings for connecting said lock pin assembly to said frame.

9. A screening or diverting system comprising:

a frame including a plurality of elongate members spaced apart for supporting a plurality of screening or diverting modules positioned thereon;

means defining at least one mounting aperture in each elongate member that is oriented normal to the plane of the elongate member;

a plurality of screening or diverting modules, each having a peripheral sidewall defining a plurality of attachment recess apertures, each said screening module including means defining an array of sieve apertures of a predetermined size for allowing particulate material up to the predetermined size to pass therethrough, and each diverting module including an impact surface for diverting said particulate material, each screening module being positioned on the frame so that particulate material passing through the screening module passes through the frame: and a lock pin assembly for readily, removably attaching said plurality of screening or diverting modules to said frame, said lock pin assembly comprising an elongate connector strip having first and second major opposite surfaces, a plurality of lock pins joined to said first major surface, and means joined to the second major surface for connecting the lock pin assembly to said frame, said lock pins including means for interlockingly and removably engaging said attachment recess apertures to maintain the positioning of each screening or diverting module on the frame when the lock pin assembly is attached to the frame, said lock pin assembly remaining connected within at least one mounting aperture of the frame while allowing removal of a screening or diverting module from the frame and positioning of a replacement screening or diverting module on the frame;

said means for connecting the lock pin assembly to the frame comprising a plurality of base sections which are removably attachable within, and detachable from, said each mounting aperture, said mounting aperture and said base sections being complementary to each other, wherein each adjacent pair of screening or diverting modules includes:

means in the sidewall defining a substantially hemi-cylindrical attachment aperture of a predetermined diameter having a longitudinal axis normal to the plane of the screening or diverting module for receiving the head portion of the lock pin; and means defining a channel extending along the side wall within the recess aperture parallel to the plane of the screening or diverting module;

the pair of modules are positioned so that the attachment apertures in the opposed sidewalls of said module are registered with each other to define, in combination, a substantially cylindrical recess aperture having a peripheral channel;

the head portion of the lock pin is generally cylindrical, having a diameter substantially equal to the diameter of the cylindrical attachment aperture for interlocking engagement in the cylindrical recess aperture, whereby a bilaterally symmetric half of the head portion extends within the recess aperture in a first one of the pair of modules and the other half of the head portion extends within the recess aperture in the second module; and the head portion of the lock pin further includes an annular collar extending around the head portion, the collar sized for interlocking engagement in the peripheral channel for removably retaining the pair of modules abutting the frame.

10. A screening or diverting system according to claim 9, wherein the lock pin base portion includes:

a generally cylindrical region having a diameter greater than the diameter of the mounting aperture;

means in the cylindrical region defining an annular recess aperture having an interior diameter substantially equal to the diameter of the mounting aperture so that, upon engagement of the base portion through the mounting aperture, the base portion lockingly engages the frame about the mounting aperture; and means in the cylindrical region defining a transverse slot having interior walls, longitudinally extending into the recess aperture from the bottom end, whereby the diameter of the cylindrical region below the recess aperture can be reduced by moving the interior walls together to facilitate insertion of the base portion through the mounting aperture.

11. A screening or diverting system according to claim 10, wherein the base portion is tapered inwardly below the recess aperture to facilitate inserting the lock pin through the mounting aperture.

12. A screening or diverting system according to claim 9, including means for removably engaging a second screening or diverting module abutting the screening or diverting module in side-by-side relationship on the frame for removably connecting the second screening or diverting module to the frame.

13. A screening or diverting apparatus for combination with a rigid frame, the apparatus comprising:

a plurality of screening or diverting modules, each screening or diverting module having a peripheral sidewall defining a plurality of attachment apertures, each said screening module including means defining an array of sieve apertures off a predetermined size for allowing particulate material up to the predetermined size to pass therethrough, and each diverting module including an impact surface for diverting said particulate material; and a lock pin assembly for readily, removably attaching said plurality of screening or diverting modules to said frame, said lock pin assembly comprising an elongate connector strip having first and second major opposite surfaces, a plurality of lock pins joined to said first major surface, and means joined to the second major surface for connecting the lock pin assembly to said frame, said lock pins including means for interlockingly and removably engaging said attachment apertures to maintain the positioning of each screening or diverting module on the frame when the lock pin assembly is attached to the frame, said lock pin assembly remaining connected within at least one mounting aperture of the frame while allowing removal of a screening or diverting module from the frame and positioning of a replacement screening or diverting module on the frame, said means for connecting the lock pin assembly to the frame comprising a plurality of base sections which are removably attachable within, and detachable from, said each mounting aperture, the frame including a plurality of elongate members spaced apart in parallel relationship, wherein:

the screening or diverting module includes parallel peripheral sidewalls and defines a flow path, the module positioned on the frame with the sidewalls extending respectively over a corresponding pair of the elongate members;

the screening or diverting module also includes means defining a hemi-cylindrical recess aperture of a predetermined diameter in the sidewall, the recess aperture having an axis generally parallel to the flow direction, and means defining a channel extending along the sidewall within the recess aperture and normal to the flow direction; and the lock pin includes a generally cylindrical head portion having a diameter complimentary to the diameter of the recess aperture for interlockingly engaging the recess aperture to maintain the positioning of the module on the frame and also includes an annular collar extending around the head portion, sized and positioned for interlockingly engaging the channel to retain the module abutting the frame.

14. A screening or diverting system according to claim 13, said plurality of base sections which attach to said frame having an annular configuration.

15. A screening or diverting apparatus for use in combination with a rigid frame, the apparatus comprising:

a plurality of screening or diverting modules, each screening or diverting module having a peripheral sidewall defining a plurality of attachment apertures, each said screening module including means defining an array of sieve apertures of a predetermined size for allowing particulate material up to the predetermined size to pass therethrough, and each diverting module including an impact surface for diverting said particulate material; and a lock pin assembly for readily, removably attaching said plurality of screening or diverting modules to said frame, said lock pin assembly comprising an elongate connector strip having first and second major opposite surfaces, a plurality of lock pins joined to said first major surface, and means joined to the second major surface for connecting the lock pin assembly to said frame, said lock pins including means for interlockingly and removably engaging said attachment apertures to maintain the positioning of each screening or diverting module on the frame when the lock pin assembly is attached to the frame, said lock pin assembly remaining connected within at least one mounting aperture of the frame while allowing removal of a screening or diverting module from the frame and positioning of a replacement screening or diverting module on the frame, said means for connecting the lock pin assembly to the frame comprising a plurality of base sections which is removably attachable within, and detachable from, said each mounting aperture, wherein said attachment aperture includes means defining a recess aperture, and said lock pins include a complimentary flange sized to fit within said recess aperture means.

16. A screening or diverting apparatus for use in combination with a rigid frame, the apparatus comprising:

a plurality of screening or diverting modules, each screening or diverting module having a peripheral sidewall defining a plurality of attachment apertures, each said screening module including means defining an array of sieve apertures of a predetermined size for allowing particulate material up to the predetermined size to pass therethrough, and each diverting module including an impact surface for diverting said particulate material; and a lock pin assembly for readily removably attaching said plurality of screening or diverting modules to said frame, said lock pin assembly comprising an elongate connector strip having first and second major opposite surfaces, a plurality of lock pins joined to said first major surface, and means joined to the second major surface for connecting the lock pin assembly to said frame, said lock pins including means for interlockingly and removably engaging said attachment apertures to maintain the positioning of each screening or diverting module on the frame when the lock pin assembly is attached to the frame, said lock pin assembly remaining connected within at least one mounting aperture of the frame while allowing removal of a screening or diverting module from the frame and positioning of a replacement screening or diverting module on the frame, said means for connecting the lock pin assembly to the frame comprising a plurality of base sections which is removably attachable within, and detachable from, said each mounting aperture, wherein said recess aperture means and said complimentary flange have a complimentay annular configuration.

17. A module system for screening or diverting particulate material comprising:

a frame for supporting a plurality of screening or diverting modules positioned thereon including means defining at lease one mounting aperture;

a plurality of screening or diverting modules, each screening or diverting module having a peripheral sidewall defining a plurality of attachment apertures, each said screening module including means defining an array of sieve apertures of a predetermined size for allowing particulate material up to the predetermined size to pass therethrough, and each diverting module including an impact surface for diverting said particulate material; and a lock pin assembly for readily, removably attaching said plurality of screening or diverting modules to said frame, said lock pin assembly comprising an elongate connector strip having first and second major opposite surfaces, a plurality of lock pins joined to said first major surface, and means joined to the second major surface for connecting the lock pin assembly to said frame, said lock pins including means for interlockingly and removably engaging said attachment apertures to maintain the positioning of each screening or diverting module on the frame when the lock pin assembly is attached to the frame, said lock pin assembly remaining connected within at least one mounting aperture of the frame while allowing removal of a screening or diverting module from the frame and positioning of a replacement screening or diverting module on the frame, said means for connecting the lock pin assembly to the frame comprising a plurality of base sections which are removably attachable within, and detachable from, said each mounting aperture, said recess aperture means and said complimentary flange have a complimentary annular configuration.

18. A screening or diverting system according to claim 17, wherein each base section is tapered inwardly along its edges and rounded adjacent its bottom end to form a blunt nose to facilitate insertion of the lock pin into the mounting aperture.

19. A screening or diverting system according to claim 17, wherein the means for attaching the lock pin assembly to the frame includes means defining a longitudinally-extending groove having interior walls such that the lower portion of the means for attaching the lock pin assembly to the frame can be reduced by moving the interior walls together.

20. A module system for screening or diverting particulate material comprising:

a frame for supporting a plurality of screening or diverting modules positioned thereon including means defining at least one mounting aperture;

a plurality of screening or diverting modules, each screening or diverting module having a peripheral sidewall defining a plurality of attachment apertures, each said screening module including means defining an array of sieve apertures of a predetermined size for allowing particulate material up to the predetermined size to pass therethrough, and each diverting module including an impact surface for diverting said particulate material;

a lock pin assembly for readily, removably attaching said plurality of screening or diverting modules to said frame, said lock pin assembly comprising an elongate connector strip having first and second major opposite surfaces, a plurality of lock pins joined to said first major surface, and means joined to the second major surface for connecting the lock pin assembly to said frame, said lock pins including means for interlockingly and removably engaging said attachment apertures to maintain the positioning of each screening or diverting module on the frame when the lock pin assembly is attached to the frame, said lock pin assembly remaining connected within at least one mounting aperture of the frame while allowing removal of a screening or diverting module from the frame and positioning of a replacement screening or diverting module on the frame, said means for connecting the lock pin assembly to the frame comprising a plurality of base sections which are removably attachable within, and detachable from, said each mounting aperture, wherein the means for attaching the lock pin assembly to the frame includes means defining a longitudinally-extending groove having interior walls such that the lower portion of the means for attaching the lock pin assembly to the frame can be reduced by moving the interior walls together, the attachment recess aperture means in the sidewall being substantially hemi-cylindrical and having its major axis substantially parallel to a flow path of the particulate material; and the head portion of the lock pin being substantially cylindrical, a section of the head portion being interlockingly engaged in the recess aperture means.

21. A screening or diverting system according to claim 20, wherein the head portion of the lock pin includes an annular collar sized and positioned on the head portion for removably retaining each screening or diverting module abutting the frame.

22. A screening or diverting system according to claim 20, wherein each base section is tapered inwardly along its edges and rounded adjacent its bottom end to form a blunt nose to facilitate insertion of the lock pin into the mounting aperture.

23. A screening or diverting system according to claim 20, wherein the means for attaching the lock pin assembly to the frame includes means defining a longitudinally-extending groove having interior walls such that the lower portion of the means for attaching the lock pin assembly to the frame can be reduced by moving the interior walls together.

* * * * *